US009966210B1

(12) United States Patent
Fasano

(10) Patent No.: US 9,966,210 B1
(45) Date of Patent: May 8, 2018

(54) CIRCUIT BREAKER WITH INTEGRATED U-LINK

(71) Applicant: Michael Fasano, Watertown, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days. days.

(21) Appl. No.: 15/395,767

(22) Filed: Dec. 30, 2016

(51) Int. Cl.
*H01H 33/42* (2006.01)
*H01H 33/08* (2006.01)
*H01H 33/53* (2006.01)

(52) U.S. Cl.
CPC ..... *H01H 33/42* (2013.01); *H01H 33/08* (2013.01); *H01H 33/53* (2013.01); *H01H 2235/01* (2013.01)

(58) Field of Classification Search
CPC ..... H01H 33/42; H01H 33/08; H01H 33/53; H01H 9/342; H01H 71/08; H01H 71/025
USPC ..... 218/148, 149, 154–156; 335/14, 16, 20
See application file for complete search history.

(56) References Cited

U.S. PATENT DOCUMENTS 2,624,815 A * 1/1953 Gano ..... H01H 71/524 218/149
3,422,235 A * 1/1969 Camp ..... H01H 73/18 200/303
3,602,852 A * 8/1971 Brackett, Sr. ..... H01H 71/46 335/202
3,786,380 A * 1/1974 Harper ..... H01H 71/1027 335/9
4,604,596 A * 8/1986 Yokoyama ..... H01H 89/10 335/14
4,771,140 A * 9/1988 Fujii ..... H01H 9/46 218/146
5,486,660 A * 1/1996 Fasano ..... H01H 71/54 200/43.16
6,667,680 B1 * 12/2003 Gibson ..... H01H 71/501 336/172
6,809,282 B2 * 10/2004 Fasano ..... H01H 9/443 218/40
6,853,274 B2 * 2/2005 Millburn ..... H01H 73/38 335/6
7,034,242 B1 * 4/2006 Shea ..... H01H 9/362 218/157

* cited by examiner

*Primary Examiner* — Renee S Luebke
*Assistant Examiner* — William Bolton
(74) *Attorney, Agent, or Firm* — Forge IP, PLLC

(57) ABSTRACT

A circuit interrupter having a moveable contact arm that forms part of the linkage assembly that connects to the handle. The moveable contact arm positioned essentially vertically in the circuit interrupter housing and positioned such that any arc that develops is drawn in a direction away from the moveable contact arm. The moveable contact arm moveable about two pivot points when the contacts are opening and closing, one of the two pivots positioned in a curved channel to slidingly move in the channel during opening and closing.

25 Claims, 5 Drawing Sheets

CIRCUIT BREAKER WITH INTEGRATED U-LINK

FIELD OF THE INVENTION

The invention relates to the field of circuit breakers. More specifically, the invention relates to a circuit breaker that incorporates a moveable contact arm with a U-Link of the escapement mechanism.

BACKGROUND OF THE INVENTION

Circuit interrupters are electrical components that can be used to break an electrical circuit, interrupting the current flow. A basic example of a circuit interrupter is a switch, which generally consists of two electrical contacts in one of two states; either closed, meaning that the contacts are touching and electricity can flow between them, or open, meaning that the contacts are separated, and no electricity can flow between them. A switch may be directly manipulated by a human to provide a control signal to a system, such as a computer keyboard button, or to control power flow in a circuit, such as a light switch.

Another example of a circuit interrupter is a circuit breaker. A circuit breaker may be used, for example, in an electrical panel to limit the electrical current being sent through the electrical wiring. A circuit breaker is designed to protect an electrical circuit from damage caused by an overload or a short circuit. If a fault condition such as a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a terminal connected to a power supply, such as a power line from a power company, and another terminal connected to the circuit that the breaker is intended to protect. Conventionally, these terminals are referred to as the "line" and "load" respectively. The line may sometimes be referred to as the input into the circuit breaker. The load, sometimes referred to as the output, feeds out of the circuit breaker and connects to the electrical components being fed from the circuit breaker.

A circuit breaker may be used to protect an individual device, or a number of devices. For example, an individual protected device, such as a single air conditioner, may be directly connected to a circuit breaker. A circuit breaker may also be used to protect multiple devices by connecting to multiple components through a power wire which terminates at electrical outlets, for example.

A circuit breaker can be used as a replacement for a fuse. Unlike a fuse however, which operates once and then must be replaced, a circuit breaker can be reset (either manually or automatically) to resume normal operation. Fuses perform much the same circuit protection role as circuit breakers. However, circuit breakers may be safer to use in some circumstances than fuses, and may be easier to fix.

For example, in a situation where a fuse blows, interrupting power to a section of a building for example, it may not be apparent which fuse controls the interrupted circuit. In this case, all of the fuses in the electrical panel would need to be inspected to determine which fuse appears burned or spent. This fuse would then need to be removed from the fuse box, and a new fuse would need to be installed.

In this respect, circuit breakers can be much simpler to use than fuses. In a situation where a circuit breaker trips, interrupting power to a section of a building for example, it may be easily apparent which circuit breaker controls the interrupted circuit by looking at the electrical panel and noting which breaker has tripped to the "off" position. This breaker can then be simply flipped to the "on" position and power will resume again.

In general, a typical circuit interrupter has two contacts located inside of a housing. The first contact is stationary, and may be connected to either the line or the load. The second contact is movable with respect to the first contact, such that when the circuit breaker is in the "off" or tripped position, a gap exists between the first and second contact.

A problem with circuit interrupters that operate by separating contacts arises because the energized contacts separate when the circuit breaker is tripped, causing a gap to widen between the contacts while the movable contact moves from the closed position to the open position.

As the contacts begin to separate from the closed position, or approach complete closure from an open position, a very small gap exists between the contacts for a brief time while the contacts are closed or opened. An electric arc may be generated across this gap if the voltage between the contacts is high enough. The creation of an arc during switching or tripping the circuit interrupter can result in undesirable side effects which can negatively affect the operation of the circuit interrupter, and which can create a safety hazard.

These effects can have consequences for the operation of the circuit interrupter. One possible consequence is that the arc may short to other objects in the circuit interrupter and/or to surrounding objects, causing damage and presenting a potential fire or electrocution safety hazard. In particular, the arc can damage the escapement, which comprises a part of the linkage that opens and closes the contacts.

Another consequence of arcing is that the arc energy damages the contacts, causing some material to escape into the air as fine particulate matter. The debris which has been melted off of the contacts can migrate or be flung into the mechanism of the circuit interrupter, destroying the mechanism or reducing its operational lifespan.

Another effect of arcing stems from the extremely high temperature of the arc (tens of thousands of degrees Celsius) which can crack the surrounding gas molecules creating ozone, carbon monoxide, and other compounds. The arc can also ionize the surrounding gasses, potentially creating alternate conduction paths.

Various techniques have been used in an attempt to mitigate the dangers associated with arcing. For example, it has been known to try and direct the arc toward arc quenching devices. However, the construction, configuration and placement of the moving parts of the circuit interrupter have left the escapement particularly vulnerable to damage caused by arcing.

Likewise, known configurations for circuit interrupters have previously included a handle external to the circuit interrupter, a catch and an escapement coupled to the handle, and a moveable contact arm positioned substantially perpendicular to the catch and escapement. While this configuration is effective in opening and closing the contacts, this configuration does place the moveable contact arm in the vicinity of any arc that is generated. Likewise, this design requires an increased number of moving parts making the device more expensive to manufacture and more timing intensive to assemble, and increases the weight of the device, which can be critical in certain applications.

It is therefore desired to provide an alternative construction for a circuit interrupter that overcomes these limitations.

SUMMARY OF THE INVENTION

Accordingly, it is an object of the present invention to provide a circuit interrupter that maximizes the distance of the moveable contact arm from arc quenching devices.

It is further desired to provide a circuit interrupter that incorporates the moveable contact arm with the escapement such that the moveable contact arm is an integral piece of the linkage assembly.

It is still further desired to provide a circuit interrupter that allows for a path of travel in the opening and closing of the contacts such that the moveable contact arm is positioned in a location opposite to the vent and positioned away from an arch runner.

It is also desired to provide a vent opening in the housing that is a single continuous vent opening and that is configured such that the arm plates each receive an opening corresponding to a cross-section of each arch plate.

These and other objectives are achieved by providing a circuit interrupter which includes a moveable contact arm on which the moveable contact is positioned and which is configured such that the moveable contact arm is part of the linkage assembly itself. In one configuration, the moveable contact arm is connected at one end to a pivot that moves in a sliding manner in a recess and at an opposite end to a catch that is coupled to the handle. In this configuration, the catch and the moveable contact arm (formed as a U-Link) form the linkage assembly. In an open position, the U-Link and the catch are positioned at an angle relative to the handle assembly. In a closed position, the U-Link and the catch are positioned substantially in line with the handle assembly.

In one configuration, the U-Link follows a radial path during opening and closing. Likewise the structure of the circuit interrupter is such that the U-Link is positioned above the set of contacts, whereas the vent is positioned opposite to the U-Link and below the set of contacts. An arc plate (or a set of arc plates) may further be positioned below the set of contacts. Still further, an arc runner may also be positioned below the set of contacts. In this manner, when the contacts are opening and an arc develops between the contacts, the arc is pulled downward toward the arc runner and arc plate(s) and therefore away from the U-Link. This is highly desirable as the arc could damage the U-Link, which being an integral part of the linkage assembly, could cause catastrophic failure of the device. The positioning of the U-Link on an opposite side from the arc quenching devices functions to protect the linkage assembly.

Traditional circuit interrupters include a handle external to the circuit interrupter, a catch and an escapement coupled to the handle at one end, and a moveable contact arm positioned substantially perpendicular to the catch and escapement and attached to the other end. Rotation of the handle causes the catch and escapement to push or pull on one end of the movable contact arm that rotates about an axis to open and close the contacts. In the current configuration, the moveable contact arm is positioned vertically (as opposed to horizontally) in the housing and is rigidly attached to the catch. This was not considered possible previously as the rotation of the handle necessarily caused the catch to displace rotationally and vertically. This was acceptable when the catch and escapement were attached to the end of the moveable contact arm because the vertical movement translated into rotational movement of the contact arm. However, in the present configuration, this arrangement was not possible because the moveable contact affixed to the moveable contact arm would then move both rotationally and vertically causing misalignment of the contacts. This problem was unexpectedly solved by providing two axis of rotation as well as a repeatable path of vertical displacement that follows a curve. The challenge was to align the moveable contact with the stationary contact after the complex path of movement upon closing of the contacts. This was achieved by the use of a channel in which a pin about which the second end of the moveable contact arm rotates while simultaneously the pin slides within the channel along a curved path.

In another configuration, where there are a plurality of arc plates used, the plurality of arc plates may be positioned along a radial path of movement of the U-Link.

It is also contemplated that a magnet may be positioned adjacent to the stationary contact and positioned such that the magnetic field produced by the magnet urges any arc that develops downward and toward the arc quenching equipment.

In still another configuration, the "stationary" contact is mounted on a plate that is deflectable such that when the U-Link moves to close the contacts, the stationary contact is moved slightly along the path of travel of the U-Link due to the deflection of the "stationary" plate on which the "stationary" contact is mounted.

In yet another configuration the arc runner is provided as a U-shaped device having an arc receiving surface that is positioned substantially in the same plane as the moveable contact when the U-Link is in an opened position. Still further, the U-Link maybe biased by means of a spring. In one embodiment, the spring biases the U-Link to the opened position.

It will be further understood that the vent provided in the bottom of the circuit interrupter housing is provided as a single continuous vent with openings corresponding at least to a cross-sectional area of each arc plate and a continuous space between each opening. The improved venting between the terminals virtually eliminates the need for the wall in the vicinity of the vents to be formed of steel or other such material or the need of an insulating material or for the wall to be grounded.

For this application the following terms and definitions shall apply:

The terms "first" and "second" are used to distinguish one element, set, data, object or thing from another, and are not used to designate relative position or arrangement in time.

The terms "coupled", "coupled to", "coupled with", "connected", "connected to", and "connected with" as used herein each mean a relationship between or among two or more devices, apparatus, files, programs, applications, media, components, networks, systems, subsystems, and/or means, constituting any one or more of (a) a connection, whether direct or through one or more other devices, apparatus, files, programs, applications, media, components, networks, systems, subsystems, or means, (b) a communications relationship, whether direct or through one or more other devices, apparatus, files, programs, applications, media, components, networks, systems, subsystems, or means, and/or (c) a functional relationship in which the operation of any one or more devices, apparatus, files, programs, applications, media, components, networks, systems, subsystems, or means depends, in whole or in part, on the operation of any one or more others thereof.

In one embodiment, a circuit interrupter is provided having a housing within which the components of the circuit interrupter are contained, the circuit interrupter comprising a line terminal connectable to a source of electrical power, a load terminal connectable to a load, a stationary contact positioned on a first plate, and a moveable contact arm having a first end and a second end, The moveable contact arm having a moveable contact positioned at the first end. the moveable contact is configured to be moveable into and out of physical contact with the stationary contact by movement of the moveable contact arm. The circuit interrupter further comprises a catch coupled to the second end of the moveable contact arm, the moveable contact arm and the catch having a longitudinal axis, and a handle provided to rotate about a pivot and including an elongated portion coupled to the catch via a linkage pivot point, the elongated portion having a longitudinal axis. The circuit interrupter is provided such that when the contacts are in an open position, the moveable contact arm and catch longitudinal axis is positioned at an angle relative to the elongated portion longitudinal axis. The circuit interrupter is further provided such that when the contacts are in a closed position, the moveable contact arm and catch longitudinal axis is substantially in line with or parallel with the elongated portion longitudinal axis.

Other objects of the invention and its particular features and advantages will become more apparent from consideration of the following drawings and accompanying detailed description.

DETAILED DESCRIPTION OF THE INVENTION

Figure 2:
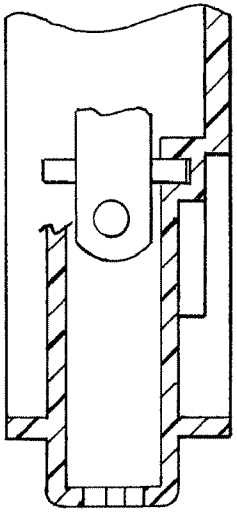
FIG. 2 is a view along Section line A-A according to FIG. 1.

Referring now to the drawings, wherein like reference numerals designate corresponding structure throughout the views.

Figure 1:
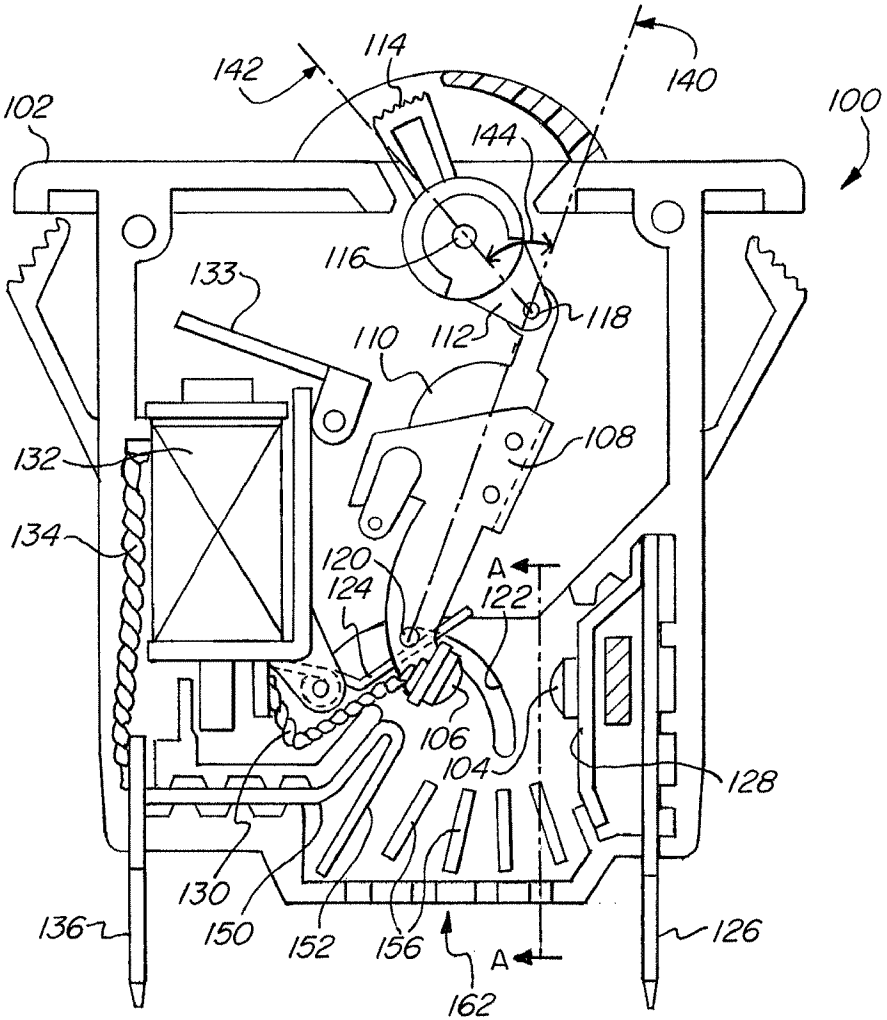
FIG. 1 is an illustration of one aspect of the circuit interrupter according to the invention.

FIG. 1 illustrates components of an example circuit interrupter 100 having a stationary and a moveable contact where a moveable contact arm is integrally formed as part of the linkage assembly according to aspects of the invention.

Circuit interrupter 100 is provided with a housing 102 that contains the working elements of the device. The circuit interrupter is further provided with a set of contacts including a stationary contact 104 and movable contact 106. The moveable contact 106 is positioned on a moveable contact arm 108.

The moveable contact arm 108 is coupled to catch 110, which is in turn, coupled to a handle 114 that includes an elongated portion 112. The moveable contact 106 is configured to move between an open and closed position relative to the stationary contact 104 by manual actuation of the handle 114.

Figure 3:
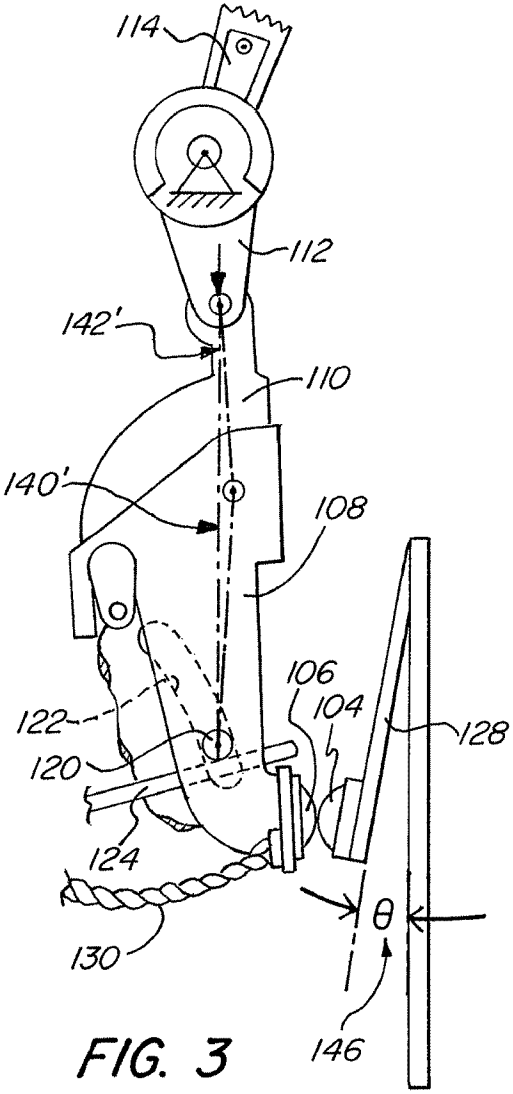
FIG. 3 is a view of the contacts in the closed position according to FIG. 1.

Reference to FIG. 1 shows the contacts 104, 106 in the open position where no electrical current flows therebetween; whereas FIG. 3 shows the contacts 104, 106 in a closed position.

Handle 114 and elongated portion 112 for the handle assembly are rigidly rotated about the handle axis 116 as a unit. Likewise, catch 110 and moveable contact arm 108 are rigidly attached to each other and move as a unit. The handle assembly is connected to the catch 110 at a pivot 118.

The moveable contact arm 108 further includes a moveable contact pivot 120 that engages with a channel 122. Moveable contact pivot 120 slides within channel 122. In FIG. 1, the moveable contact pivot 120 is positioned at one end of channel 122, however, moveable contact arm 108 rotates about moveable contact pivot 120 during closing of the contacts, the moveable contact pivot 120 slides within channel 122 to an opposite end of the channel as illustrated in FIG. 3.

Also illustrated in FIG. 1 is biasing device 124, which in this configuration comprises a spring and is provided to bias the moveable contact pivot 120 toward one end of the channel 122. In the example provided in FIG. 1, the biasing device 124 functions to bias the contacts in the open position.

Also shown in FIG. 1 is a "line" terminal 126, which is designed to be connected to a source of electrical power, such as a bus bar in a panel board or load center. Stationary contact 104 is mounted onto a first plate 128, which in turn is electrically connected to line terminal 126.

Moveable contact 106 mounted on moveable contact arm 108 includes a connection 130 that electrically connects the moveable contact 106 to a current measurement device 132. Current measurement device 132 is likewise connected to a connector 134 that is electrically connected to a "load" terminal 136.

In operation, electrical power is input into circuit interrupter 100 via line terminal 126, which passes through current measurement device 132. If the electrical current exceeds a threshold level, current measurement device 132 will function to "trip" the circuit interrupter 100 by opening the circuit (opening the contacts relative to each other by means of a trip mechanism 133) such that the flow of electrical current through the contacts ceases. In the event that the electrical current does not exceed the threshold level set by current measurement device 132, the electrical power is allowed to pass through load terminal 136, which in turn, provides electrical power to the connected circuit and/or equipment.

In FIG. 1 it can be seen that catch 110 and moveable contact arm 108 are rigidly affixed to each other and define a longitudinal axis 140, while elongated portion 112 also defines a longitudinal axis 142 (both of which are better illustrated in FIG. 4) and shown in the open position and form an angle θ 144, which in one configuration is greater than 30 degrees and in another configuration is greater than 45 degrees.

Figure 4:
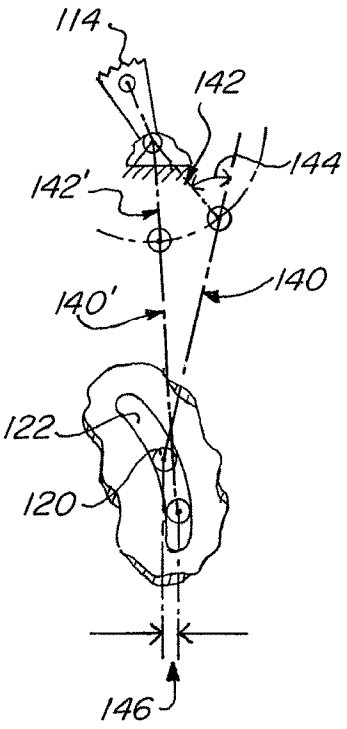
FIG. 4 is a diagram of the angular relationship of the linkage and the handle in both the open and closed positions.

Alternatively, FIG. 4 shows longitudinal axis 140' and longitudinal axis 142', which corresponds to the contacts in the closed positions as illustrated in FIG. 3. In this instance, longitudinal axis 140' and longitudinal axis 142' are substantially coaxial or at least substantially parallel.

Figure 8:
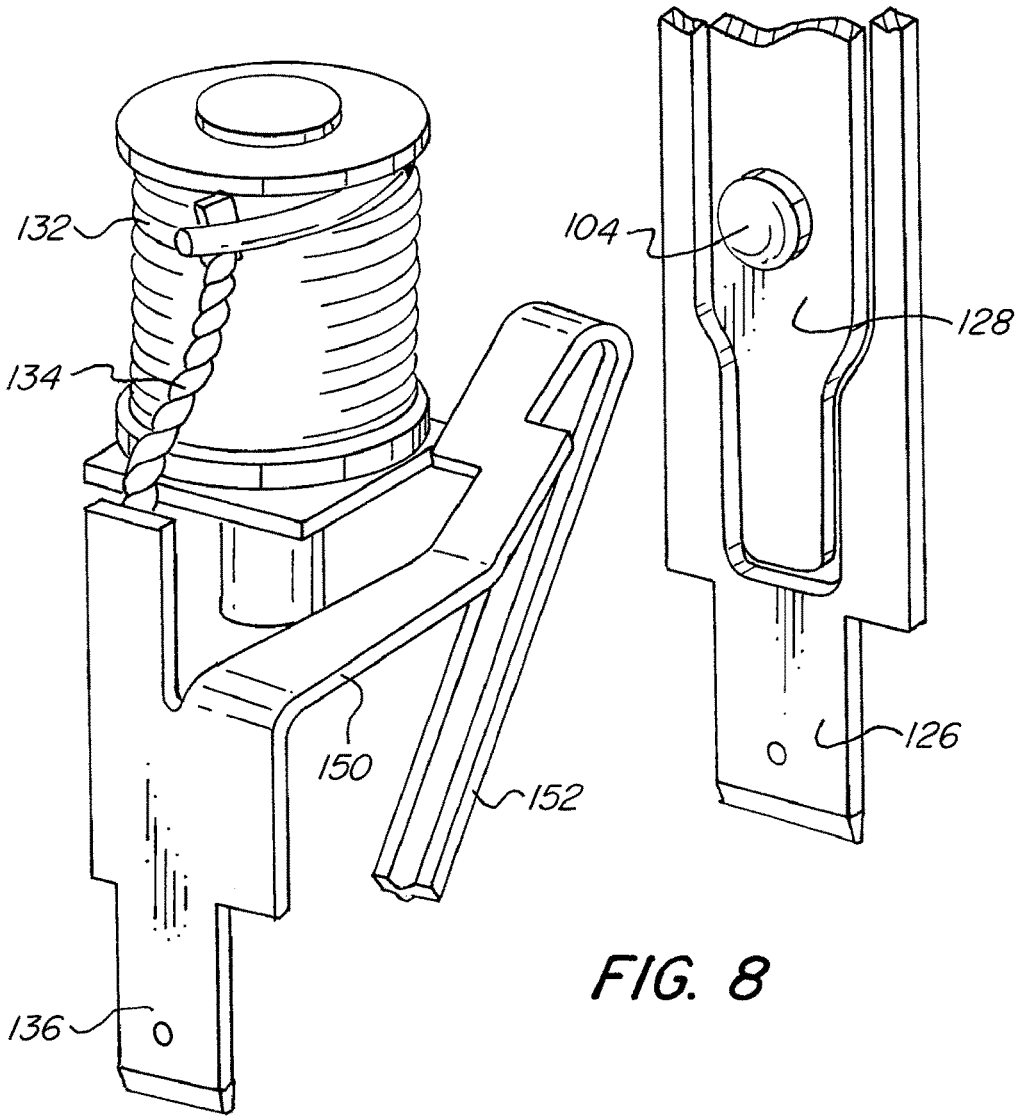
FIG. 8 is a perspective view of the stationary contact and the arc runner according to FIG. 1.

At the bottom of FIG. 4 a deflection distance 146 is illustrated by the two arrows facing each other. Deflection distance 146 represents the deflection of stationary contact 104 mounted on first plate 128 as first plate 128 gives under the closing force exerted by moveable contact arm 108. In one configuration, first plate 128 is provided connected at one end to the line terminal 126 and is formed having surfaces in multiple planes (FIG. 1) or alternatively, as a plate having a surface in one plane (FIG. 3) or as shown in perspective view in FIG. 8.

FIG. 2 is a section view along section line A-A of FIG. 1.

Figure 5:
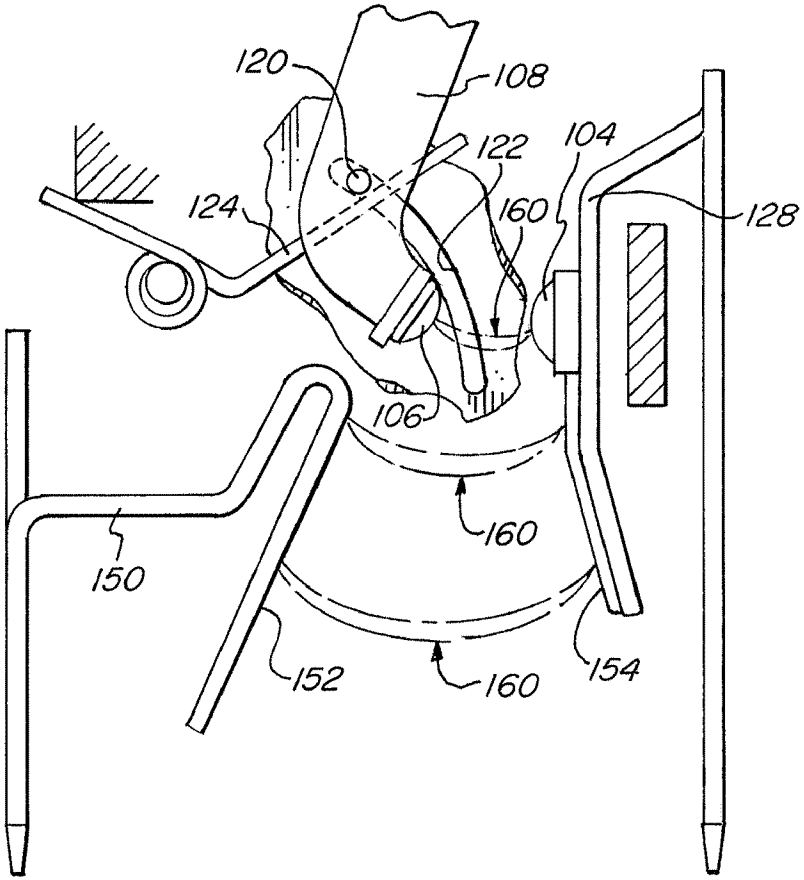
FIG. 5 is a view of the contacts in an open position and the formation of an arc that is transferred to the arc runner according to FIG. 1.
Figure 9:
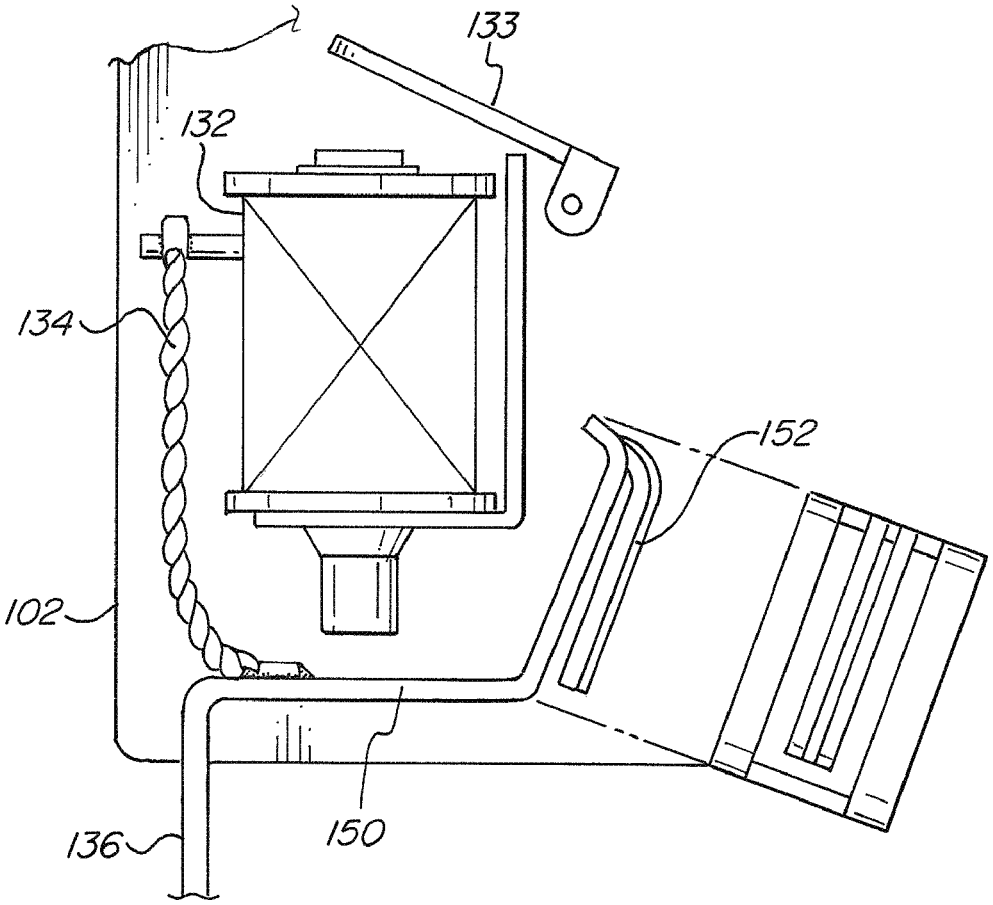
FIG. 9 is an alternative terminal design according to FIG. 1.

Also illustrated in FIG. 1 is arc runner 150 formed as a U-shaped device (FIGS. 1 & 8), which includes arc receiving surface 152. Likewise, first plate 128 includes a surface 154 that extends downward (FIG. 1) from stationary contact 104 and functions to receive an arc 160 that forms in between the contacts and is better illustrated in FIG. 5. As can be seen in FIG. 5, the arc 160 forms between the contacts 104, 106 and is passed toward the arc receiving surface 152 and surface 154 and moves away from the contacts. An alternative embodiment is illustrated in FIG. 9. It can be seen that alternative configurations can be used while not deviating from the invention.

Also shown in FIG. 1 are arc plates 156, which are provided to assist in drawing arc 160 away from the contacts. In one configuration, arc plates 156 are positioned in a radial path that corresponds to the path of movement of the moveable contact 106.

Figure 6:
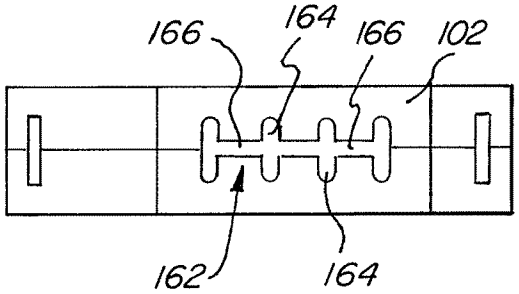
FIG. 6 is a bottom view of the housing illustrating the vents according to FIG. 1.

Additionally, vent 162 is positioned in the underside of the housing 102. Vent 162 is better illustrated in FIG. 6 where the underside of the housing 102 is shown. As can be seen, vent 162 is formed of a number of openings 164, which are positioned based on the positioning of the arc plates 156. In one configuration, the size of each opening 164 is at least as large as the cross sectional area of each arc plate 156. It can further be seen that in some configurations, the vent 162 is actually a single vent opening as each opening 164 is connected to an adjacent opening 164 via an opening 166. It can be seen that the openings 166 are typically smaller in size than the openings 164.

Figure 7:
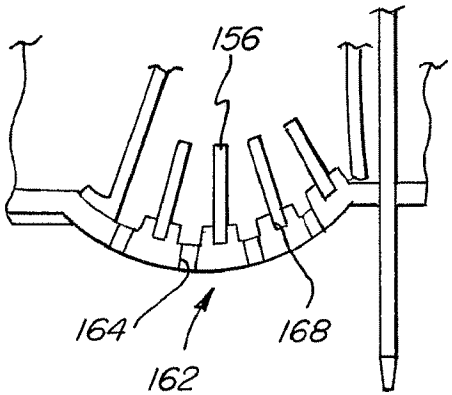
FIG. 7 is an alternative positioning of the arc plates according to FIG. 1.

FIG. 7 illustrates yet another embodiment where the housing 102 is provided with a rounded wall with openings 164 positioned therein that correspond to the positioning of the arc plates 156 along a radial path. It can also be seen that the arc plates are positioned and held in a recess 168 that is located in an inner side of the rounded wall.

In reviewing the features of the invention, it can be seen that the novel placement of the moveable contact arm 108 in a vertical position (in FIG. 1) such that the moveable contact arm 108 forms part of the linkage assembly connecting to the handle, places the moveable contact arm away from any arc that may develop and will be drawn downward (away from the moveable contact arm). Additionally, this configuration functions to lessen the number of parts in the circuit interrupter, lowering the cost and the making the device lighter in weight and easier to assemble.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A circuit interrupter having a housing within which components of the circuit interrupter are contained, the circuit interrupter comprising:

a line terminal connectable to a source of electrical power;

a load terminal connectable to a load;

a stationary contact positioned on a first plate;

a moveable contact arm having a first end and a second end, said moveable contact arm having a moveable contact positioned at the first end, said moveable contact configured to be moveable into and out of physical contact with said stationary contact by movement of said moveable contact arm;

a catch coupled to the second end of said moveable contact arm, said moveable contact arm and said catch defining a longitudinal axis;

a handle provided to rotate about a pivot and including an elongated portion coupled to said catch via a linkage pivot point, the elongated portion having a longitudinal axis;

wherein when the contacts are in an open position, the longitudinal axis defined by the moveable contact arm and catch is positioned at an angle relative to the longitudinal axis defined by the elongated portion;

wherein when the contacts are in a closed position, the longitudinal axis defined by the moveable contact arm and catch is substantially in line with or parallel with the longitudinal axis defined by the elongated portion; and a moveable contact pivot connected to the first end of said moveable contact arm and a channel within which the moveable contact pivot is positioned, wherein movement of said moveable contact arm between the open and closed position causes said moveable contact pivot to slide from one end of said channel to an opposite end of said channel.

2. The circuit interrupter of claim 1, wherein when the contacts are in the open position the angle is greater than 30 degrees.

3. The circuit interrupter of claim 2, wherein when the contacts are in the open position the angle is greater than 45 degrees.

4. The circuit interrupter of claim 1, wherein said moveable contact arm and said catch are rigidly affixed to each other.

5. The circuit interrupter of claim 1, wherein said first plate is deflectable such that when said moveable contact comes into physical contact with said stationary contact, said first plate deflects due to a closing force exerted on said first plate by said moveable contact arm.

6. The circuit interrupter of claim 1, further comprising an arc runner having an arc receiving surface for receiving an arc that develops between the contacts.

7. The circuit interrupter of claim 6, wherein said arc runner is configured as a U-shape.

8. The circuit interrupter of claim 6, wherein when the movable contact in open position, the arc receiving surface lays substantially in a plane with a surface on which said movable contact is positioned.

9. The circuit interrupter of claim 6, further comprising a vent positioned in said housing and located adjacent to said contacts for venting debris and gas caused by arcing.

10. The circuit interrupter of claim 9, wherein said first plate extends from said stationary contact and toward said vent and said arc receiving surface extends from said moveable contact and toward said vent, said first plate and said arc receiving surface working in conjunction with each other to receive an arc that develops between said contacts.

11. The circuit interrupter of claim 10, wherein a distance between the first plate and arc receiving surface is smallest at a position nearest said contacts and increases toward said vent.

12. The circuit interrupter of claim 9, further comprising at least one arc plate positioned adjacent to said vent for quenching the arc.

13. The circuit interrupter of claim 12, wherein said arc plate comprises a plurality of arc plates and said vent includes an arc plate opening at least corresponding to a cross sectional area for each arc plate and aligned with an end of each of the plurality of arc plates.

14. The circuit interrupter of claim 13, wherein said vent is formed as a single continuous vent with openings in the housing between each arc plate opening.

15. The circuit interrupter of claim 14, wherein the openings in the housing between each arc plate opening are smaller than each arc plate opening.

16. The circuit interrupter of claim 13, wherein said moveable contact arm follows a radial path of movement and said plurality of arch plates are positioned along the radial path of movement of said moveable contact.

17. The circuit interrupter of claim 9, further comprising a permanent magnet positioned adjacent to said stationary contact to urge the arc toward said first plate and said arc runner.

18. The circuit interrupter of claim 1, wherein said channel comprises a curved path within which said moveable contact pivot slides.

19. The circuit interrupter of claim 1, further comprising a biasing member to bias said moveable contact arm toward the open position.

20. The circuit interrupter of claim 19, wherein said biasing member engages with said moveable contact pivot to bias said moveable contact pivot toward one end of said channel.

21. The circuit interrupter of claim 1, further comprising a current measurement device connected in series with said line terminal and said load terminal.

22. The circuit interrupter of claim 1, further comprising a handle guard extending over top of said handle.

23. A circuit interrupter having a housing within which components of the circuit interrupter are contained, the circuit interrupter comprising:

a line terminal connectable to a source of electrical power;

a load terminal connectable to a load;

a stationary contact positioned on a first plate;

a moveable contact arm having a first end and a second end, said moveable contact arm having a moveable contact positioned at the first end, said moveable contact configured to be moveable into and out of physical contact with said stationary contact by movement of said moveable contact arm;

a catch rigidly attached to the second end of said moveable contact arm, said moveable contact arm and said catch defining a longitudinal axis;

a handle provided to rotate about a pivot and including an elongated portion coupled to said catch via a linkage pivot point, the elongated portion having a longitudinal axis;

a moveable contact pivot connected to the first end of said moveable contact arm; and a channel comprising a curved path within which the moveable contact pivot is positioned;

wherein movement of said moveable contact arm between the open and closed position causes said moveable contact pivot to slide from one end of said channel to an opposite end of said channel;

wherein when the contacts are in an open position, the longitudinal axis defined by the moveable contact arm and catch is positioned at an angle relative to the longitudinal axis defined by the elongated portion; and wherein when the contacts are in a closed position, the longitudinal axis defined by the moveable contact arm and catch is substantially in line with or parallel with the longitudinal axis defined by the elongated portion.

24. The circuit interrupter of claim 23, wherein said first plate is deflectable such that when said moveable contact comes into physical contact with said stationary contact, said first plate deflects due to a closing force exerted on said first plate by said moveable contact arm.

25. A circuit interrupter having a housing within which components of the circuit interrupter are contained, the circuit interrupter comprising:

a line terminal connectable to a source of electrical power;

a load terminal connectable to a load;

a stationary contact positioned on a first plate;

a moveable contact arm having a first end and a second end, said moveable contact arm having a moveable contact positioned at the first end, said moveable contact configured to be moveable into and out of physical contact with said stationary contact by movement of said moveable contact arm;

a catch coupled to the second end of said moveable contact arm, said moveable contact arm and said catch defining a longitudinal axis;

a handle provided to rotate about a pivot and including an elongated portion coupled to said catch via a linkage pivot point, the elongated portion having a longitudinal axis;

wherein said moveable contact arm and said catch together define a rigid member pivotable about a catch pivot point on one end and carrying said moveable contact on an opposite end such that said moveable contact is pivotable in an arc about the catch pivot point;

wherein when the contacts are in an open position, the longitudinal axis defined by the moveable contact arm and catch is positioned at an angle relative to the longitudinal axis defined by the elongated portion; and wherein when the contacts are in a closed position, the longitudinal axis defined by the moveable contact arm and catch is substantially in line with or parallel with the longitudinal axis defined by the elongated portion.

* * * * *